US010539317B2

(12) United States Patent
Werner et al.

(10) Patent No.: US 10,539,317 B2
(45) Date of Patent: Jan. 21, 2020

(54) HANDHELD TOOL CARRYING CASE

(75) Inventors: Uwe Werner, Hütten (CH); Georgios Margaritis, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 656 days.

(21) Appl. No.: 13/699,795

(22) PCT Filed: Apr. 5, 2011

(86) PCT No.: PCT/EP2011/055267

§ 371 (c)(1),
(2), (4) Date: Mar. 6, 2013

(87) PCT Pub. No.: WO2011/147625

PCT Pub. Date: Dec. 1, 2011

(65) Prior Publication Data

US 2013/0155657 A1 Jun. 20, 2013

(30) Foreign Application Priority Data

May 27, 2010 (DE) ..... 10 2010 029 342
Jan. 3, 2011 (DE) ..... 10 2011 002 409

(51) Int. Cl.
*F21V 33/00* (2006.01)
*B25H 3/02* (2006.01)
*B65D 85/00* (2006.01)

(52) U.S. Cl.
CPC ..... *F21V 33/0084* (2013.01); *B25H 3/02* (2013.01); *B25H 3/023* (2013.01); *B65D 85/00* (2013.01); *F21V 33/00* (2013.01)

(58) Field of Classification Search
CPC ..... F21V 33/0084; B25F 5/021
USPC ..... 362/154
See application file for complete search history.

(56) References Cited

U.S. PATENT DOCUMENTS

| | | | | |
|---|---|---|---|---|
| 2,061,413 | A | 11/1936 | Tropea | |
| 3,964,193 | A | 6/1976 | Degenhardt et al. | |
| 6,053,315 | A | 4/2000 | Yao | |
| 6,237,767 | B1 | 5/2001 | Lee | |
| 6,244,064 | B1 | 6/2001 | Powell et al. | |
| 6,254,251 | B1 | 7/2001 | Washington | |
| 6,267,240 | B1 * | 7/2001 | Callaway | 206/373 |
| 6,662,945 | B1 * | 12/2003 | Chang | 206/372 |
| 6,981,780 | B2 | 1/2006 | Einav | |
| 7,055,983 | B1 * | 6/2006 | Baker | A01K 97/06 362/154 |
| 2004/0125597 | A1 | 7/2004 | Einav | |
| 2004/0228114 | A1 * | 11/2004 | Chen | 362/84 |

(Continued)

FOREIGN PATENT DOCUMENTS

| | | |
|---|---|---|
| CN | 1814405 | 8/2006 |
| CN | 2842201 | 11/2006 |

(Continued)

OTHER PUBLICATIONS

International Search Report, International Application No. PCT/EP2011/055267, dated Jun. 1, 2011.

*Primary Examiner* — Sean P Gramling
(74) *Attorney, Agent, or Firm* — Norton Rose Fulbright US LLP; Gerard Messina

(57) ABSTRACT

A handheld tool carrying case having a carrying case base and a carrying case cover and at least one electronic system. The carrying case base is connected to the carrying case cover in a detachable fashion.

21 Claims, 4 Drawing Sheets

(56) References Cited

U.S. PATENT DOCUMENTS

| | | | | |
|---|---|---|---|---|
| 2004/0237374 | A1* | 12/2004 | Klein | 43/21.2 |
| 2005/0157505 | A1 | 7/2005 | Dow et al. | |
| 2005/0241973 | A1 | 11/2005 | Adkins | |
| 2008/0035507 | A1 | 2/2008 | Collister et al. | |
| 2008/0198578 | A1* | 8/2008 | Finn | A41B 9/04 362/103 |
| 2009/0301913 | A1 | 12/2009 | Scaletta et al. | |
| 2010/0236955 | A1* | 9/2010 | Lase | 206/373 |
| 2012/0206907 | A1 | 8/2012 | Seidel | |

FOREIGN PATENT DOCUMENTS

| | | | |
|---|---|---|---|
| CN | 201132309 | Y | 10/2008 |
| DE | 83 17 956 | | 1/1984 |
| TW | 200424043 | A | 11/2004 |
| WO | WO 2005/061186 | | 7/2005 |
| WO | WO 2005/107516 | | 11/2005 |
| WO | WO 2011/003678 | | 1/2011 |

* cited by examiner

HANDHELD TOOL CARRYING CASE

FIELD

The present invention relates to a handheld tool carrying case.

SUMMARY

The present invention relates to a handheld tool carrying case having a carrying case base and a carrying case cover and at least one electronic system.

In accordance with the present invention, a base of the carrying case is detachably connected to the cover of the carrying case. Preferably, the base of the carrying case or preferably the cover of the carrying case has the electronic system. A "carrying case base" is to be understood in particular as a part of the handheld tool carrying case that is provided for placing a handheld tool in an accommodating region when the carrying case cover is open. The carrying case base preferably has at least one fastener for the handheld tool. The fastener preferably fastens the handheld tool in a direction parallel to a main extension of the carrying case base, particularly in a form-locking manner and/or also when the carrying case cover is open. The handheld tool may include, for example, a power drill, a hammer drill, a saw, a plane, a screwdriver, a milling tool, a grinder, an angle sander, a gardening tool and/or a multifunctional tool. A "carrying case cover" is to be understood in particular as a part of the handheld tool carrying case which, in a closed state, covers the accommodating region of the carrying case base, at least for the most part. In a direction perpendicular to its main extension, the carrying case cover preferably has a smaller spatial extension than the carrying case base has in a direction perpendicular to its main extension. An "electronic system" is to be understood in particular as a device that influences at least one electrical current in a gas, in a conductor, in a vacuum and/or advantageously in a semiconductor. The electronic system preferably has at least one voltage transformer. The carrying case base and the carrying case cover are preferably developed to be electrically separate, that is, the carrying case base and the carrying case cover are in particular insulated from each other. "Provided" is to be understood in particular as specially programmed, designed and/or equipped. The expression "detachably connected" is to be understood in particular in the sense that a mechanical connection of the carrying case base and the carrying case cover may be opened by an operator in a non-destructive manner and in particular involving only reversible deformations of material. The carrying case base is preferably connected to the carrying case cover via a hinge, which is disconnectable using an operating element, a screw and/or another practical means. The carrying case base is preferably connected to the carrying case cover so as to be detachable without the use of a tool. "Detachable without the use of a tool" is to be understood in particular in the sense that an operator is able to open a mechanical connection between the carrying case base and the carrying case cover by hand. One development of the handheld tool carrying case according to the present invention makes it possible to retrofit a handheld tool carrying case without electronic functionality in a cost-effective manner and with little effort advantageously with a carrying case base or a carrying case cover having a function provided by the electronic system to form a handheld tool carrying case according to the present invention. In addition, the carrying case cover for example may be separated from the carrying case base in order to fulfill the function. As a result, it is not necessary, for example, to move the entire handheld tool carrying case to the place where the functionality is to be utilized.

In accordance with the present invention, at least the carrying case base or the carrying case cover may include at least one battery interface and one lighting device, which are connected at least in part fixedly to the carrying case base or fixedly to the carrying case cover, whereby an advantageously retrofittable lighting device may be operated independently of a power network. A "battery interface" is to be understood in particular as an interface designed to contact a rechargeable battery at least electrically. The battery interface is preferably provided to fasten the battery mechanically. The battery interface is preferably provided to contact a handheld machine tool battery. Advantageously, the battery interface is provided to supply the electronic system with electrical power. The battery connected to the battery interface is preferably located in the accommodating region. Alternatively or additionally, the battery could be insertable into a battery slot from outside while the carrying case cover is closed. A "lighting device" is to be understood in particular as a device that has at least one lighting device and an optical system. The lighting device is preferably an incandescent bulb, an energy-saving lamp, a fluorescent strip lamp, advantageously as an LED and/or another lighting device. The optical system could have a light guide, a reflective film, a diffuser, an BFE film and/or other optical elements. The electronic system preferably supplies the lighting device with electrical power. The term "fixedly" is to understood in particular in such a way that, following a separation of the carrying case cover from the carrying case base, the battery interface is connected to the carrying case cover or to the carrying case base. Alternatively or additionally, the lighting device could be connected to the carrying case cover or to the carrying case base in such a way that an operator is able to separate it in a non-destructive manner. Preferably, the lighting device could be designed to be replaced by another, preferably electronic functional unit such as for example by a blind cover, a mirror, a writing area, an insertable tool holder, a media playback unit, in particular having an mp3/mp4 function, an image display function and/or a radio.

The carrying case cover preferably has at least one fastener for fastening the battery interface. Alternatively or additionally, the carrying case base or preferably the carrying case cover could be developed at least in part as one piece with the battery interface. The development of the handheld tool carrying case according to the example embodiment of the present invention allows for a particularly comfortable and mobile operation of the lighting device.

The present invention furthermore provides for the handheld tool carrying case to comprise a lighting device and an orientation device, which is provided to fix at least a part of the carrying case base or the carrying case cover, preferably the lighting device, relative to a resting plane of the carrying case base or the carrying case cover, in a pivotable manner in various orientations. The orientation device is preferably provided to act between the carrying case base and the carrying case cover. Alternatively or additionally, the orientation device could act in at least one operating state between the resting plane and the carrying case cover or the carrying case base, which means that the orientation device is provided to fixate the carrying case base and the carrying case cover jointly relative to a resting plane of the carrying case base in a pivotable manner in various orientations. A "resting plane" is to be understood in particular as an advantageously imaginary plane, which is identical to a plane formed by a contact area, on which the handheld tool carrying case is placed according to its function in order to be opened. This means preferably that, when opening the handheld tool carrying case once it is set down on the contact area, the fasteners mounted in the carrying case base fulfill their function. The resting plane is preferably facing away from the light emission surface in at least one operating state, preferably by more than 150 degrees. The term "pivotable" is to be understood in particular in such a way that the part of the carrying case base or preferably of the carrying case cover is supported relative to the resting plane so as to be movable at least about one axis. "Fixate" in this context is to be understood in particular to mean that the orientation device in at least one operating state prevents a pivoting motion of the part of the carrying case base or preferably of the carrying case cover relative to the resting plane of the carrying case base. The orientation device preferably fixates the part of the carrying case base or preferably of the carrying case cover in different orientations relative to the resting plane of the carrying case base. The orientation device preferably has at least one latching mechanism. The development of the handheld tool carrying case according to the present invention allows for an orientation of the carrying case base or preferably the carrying case cover that is advantageous for a lighting device. For example, the lighting device may be oriented advantageously onto a work area.

One advantageous development in accordance with the present invention provides for the electronics to be connected in a mechanically fixed manner to the carrying case cover, which makes it possible to retrofit various carrying case bases, which are associated with different handheld tools, with a uniform carrying case cover having an electronic function. "Mechanically fixed" is to be understood in this connection to mean in particular that the electronics and the carrying case cover are connected in an immovable fashion relative to each other.

Another development in accordance with the present invention provides for the carrying case base and/or advantageously the carrying case cover to have at least one lighting device, which forms at least one part of an outer side, whereby the handheld tool carrying case is able to replace or supplement, in a structurally simple and convenient fashion, a work lamp or other lamps, for example in a motor vehicle. Alternatively or additionally to the lighting device, the carrying case base and/or advantageously the carrying case cover may also have other functional units that seem practical to one skilled in the art such as, for example, a USB output and/or a media playback unit, having an mp3/mp4 function, an image display function and/or a radio. An "outer side" is to be understood in particular as a surface, which bounds the carrying case base and/or the carrying case cover advantageously when the carrying case cover is closed vis-à-vis a space surrounding the handheld tool carrying case. When the carrying case cover is closed, the lighting device preferably forms a part of an outer side of the carrying case base or particularly preferably of the carrying case cover.

The present invention furthermore provides for the lighting device to have a light emission surface that is greater than 50 $cm^2$, which makes it possible to avoid an operator from being blinded by the lighting device and prevent a disadvantageous formation of shadows. Advantageously, the light emission surface is greater than 100 $cm^2$, particularly advantageously greater than 200 $cm^2$. Alternatively or additionally, the lighting device could have a light emission surface, which is at least 10%, advantageously at least 25%, particularly advantageously at least 50% of a surface that comprises an outer surface of the handheld tool carrying case situated at least essentially in parallel to the light emission surface. "At least essentially" is to be understood in this connection in particular as that the outer surface is oriented at less than 30 degrees difference from the light emission surface. A "light emission surface" is to be understood in particular as a region of the outer side that is permeated by light of the lighting device, in particular a single pane protecting the lighting device. Alternatively or additionally, a "light emission surface" could be understood as a smallest contiguous surface formed by an extent of the lighting means, and, in particular, if the light diodes are situated in such a way that they are not covered by a continuous pane.

An example embodiment of the present invention furthermore provides for the handheld tool carrying case to have a stacking arrangement, which is designed to transmit a force in the direction of the carrying case base and/or advantageously of the carrying case cover. A "stacking arrangement" is to be understood in particular as an arrangement that effects at least one counteracting force on the path between a stacking surface and the carrying case base and/or the carrying case cover when multiple handheld tool carrying cases are stacked in particular on a palette in accordance with specifically provided regulations. Advantageously, the stacking arrangement conducts a force from the stacking surface to a side wall of the carrying case cover and/or of the carrying case base. The stacking arrangement may be developed as a reinforcement. Alternatively or additionally, the stacking arrangement could transmit a force separately from the side wall directly between the carrying case cover and the carrying case base. The stacking arrangement advantageously makes it possible to prevent the carrying case from being damaged, in particular when transporting multiple carrying cases on a palette.

An example embodiment of the present invention furthermore provides for the carrying case base and/or advantageously the carrying case cover to have at least one add-on module fastener, which is provided to fasten a functional add-on module, in particular so as to be separable without the use of a tool, whereby an operator is able to retrofit the handheld tool carrying case with additional functions with little effort. An "add-on module fastener" is to be understood in particular as a device that establishes in an operating state a mechanically fixed and in particular electrical connection to the add-on module. In particular, a "functional add-on module" is to be understood as a device that adds at least one function to the handheld tool carrying case such as, for example, an in particular additional lighting device, a media playback device and/or a mount for tools and/or insertable tools. Alternatively or additionally, the add-on module fastener fastens the lighting device, which forms at least part of the outer side.

In accordance with the present invention, the handheld tool carrying case may also have at least one battery interface, which is provided to supply at least the electronic system with electrical power, which makes it possible with little effort to operate the electronic system at least for a time independently of the power network. Alternatively and in particular additionally, the battery interface could be provided to charge a battery.

The present invention furthermore provides for the handheld tool carrying case to have a power input, which is provided to take up an energy from a power network, whereby the electronic system may be advantageously supplied with energy and in particular a battery connected to the battery interface may be charged. A "power input" is to be understood in particular as an electrical interface that is provided to be connected to a power network of a power provider, in particular to a 230 V, 50 Hz and/or 110 V, 60 Hz power network.

The handheld tool carrying case furthermore has an electrical operating element, which is disposed so as to be operable when the carrying case cover is closed, which allows for a particularly comfortable operation of the electronic system and in particular of the lighting device. An "operating element" is to be understood in particular as a switch and/or another practical operating element. The operating element is preferably situated on the carrying case cover. Alternatively or additionally, the operating element could be situated on the carrying case base, advantageously on the handle of the carrying case base.

One advantageous development in accordance with the present invention provides for the operating element to be designed to be operated by stacking multiple handheld tool carrying cases, which makes it possible to achieve advantageous functions such as an automatic switch-off when stacking, for example. The expression "by stacking multiple handheld tool carrying cases" is to be understood to mean in particular that when setting handheld tool carrying cases against or on top of each other, one handheld tool carrying case actuates the operating element of the other handheld tool carrying case.

The present invention furthermore provides for the handheld tool carrying case to have at least one sealing arrangement, which effects a seal between the carrying case base and the carrying case cover when the carrying case cover is closed, whereby the accommodating region is advantageously protected. A "sealing arrangement" is to be understood in particular as a means that prevents humidity and/or dirt from entering the accommodating region when the carrying case cover is closed. The sealing arrangement is preferably developed as a sealing ring, a sealing lip, advantageously as a labyrinth seal, and/or as another practical means. In particular, when the carrying case cover is closed, the accommodating region is protected at least according to protective class IP 20, advantageously at least according to IP 52, particularly advantageously at least according to IP 65.

BRIEF DESCRIPTION OF THE DRAWINGS

Further advantages may be derived from the description below of the figures. The figures show three exemplary embodiments of the present invention. The figures and the description contain numerous features in combination. The features may also be considered individually, and may also be combined into useful further combinations.

DETAILED DESCRIPTION OF EXAMPLE EMBODIMENTS

Figure 1:
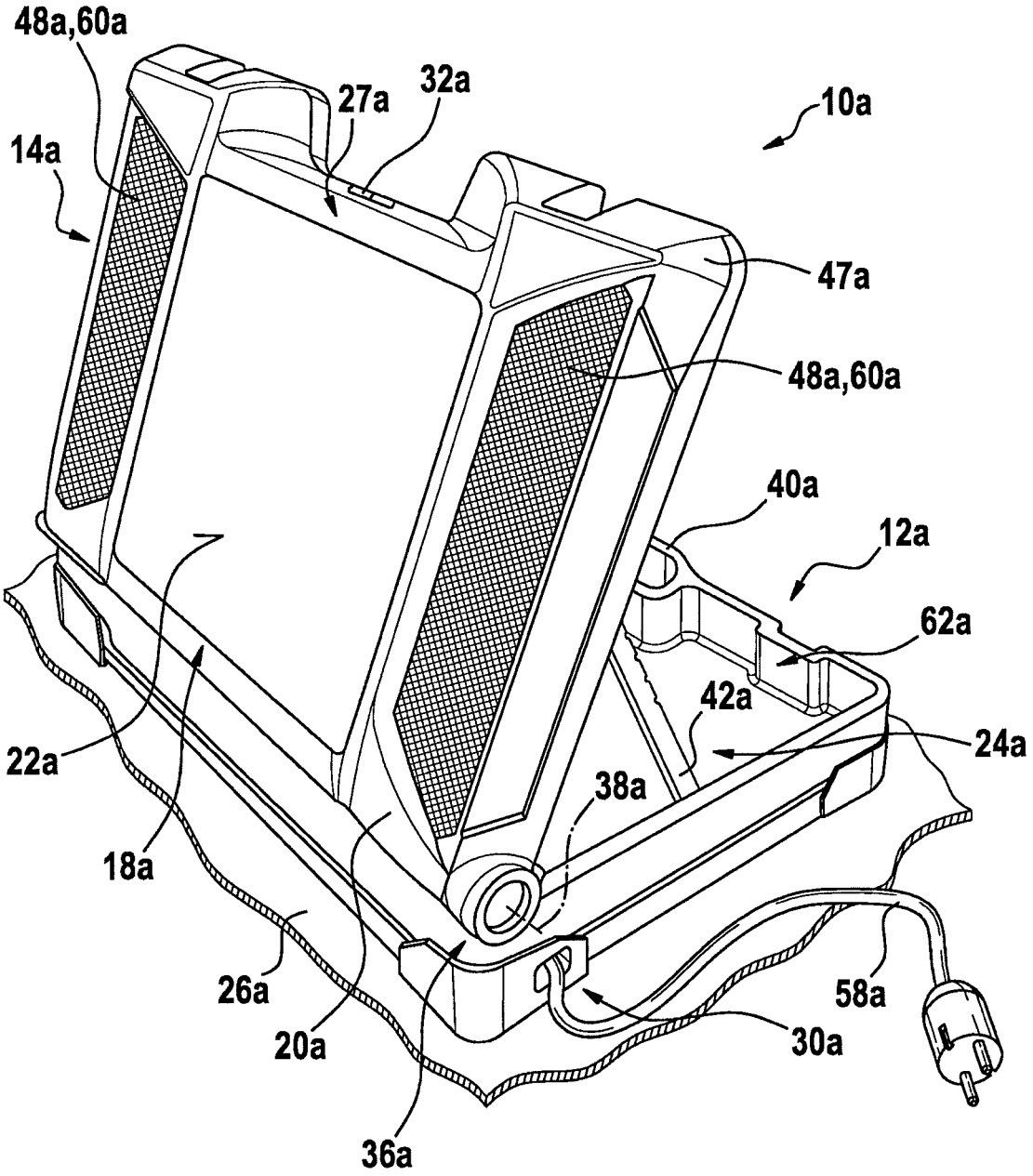
FIG. 1 shows an open handheld tool carrying case according to an example embodiment of the present invention having a lighting device in a perspective representation.
Figure 2:
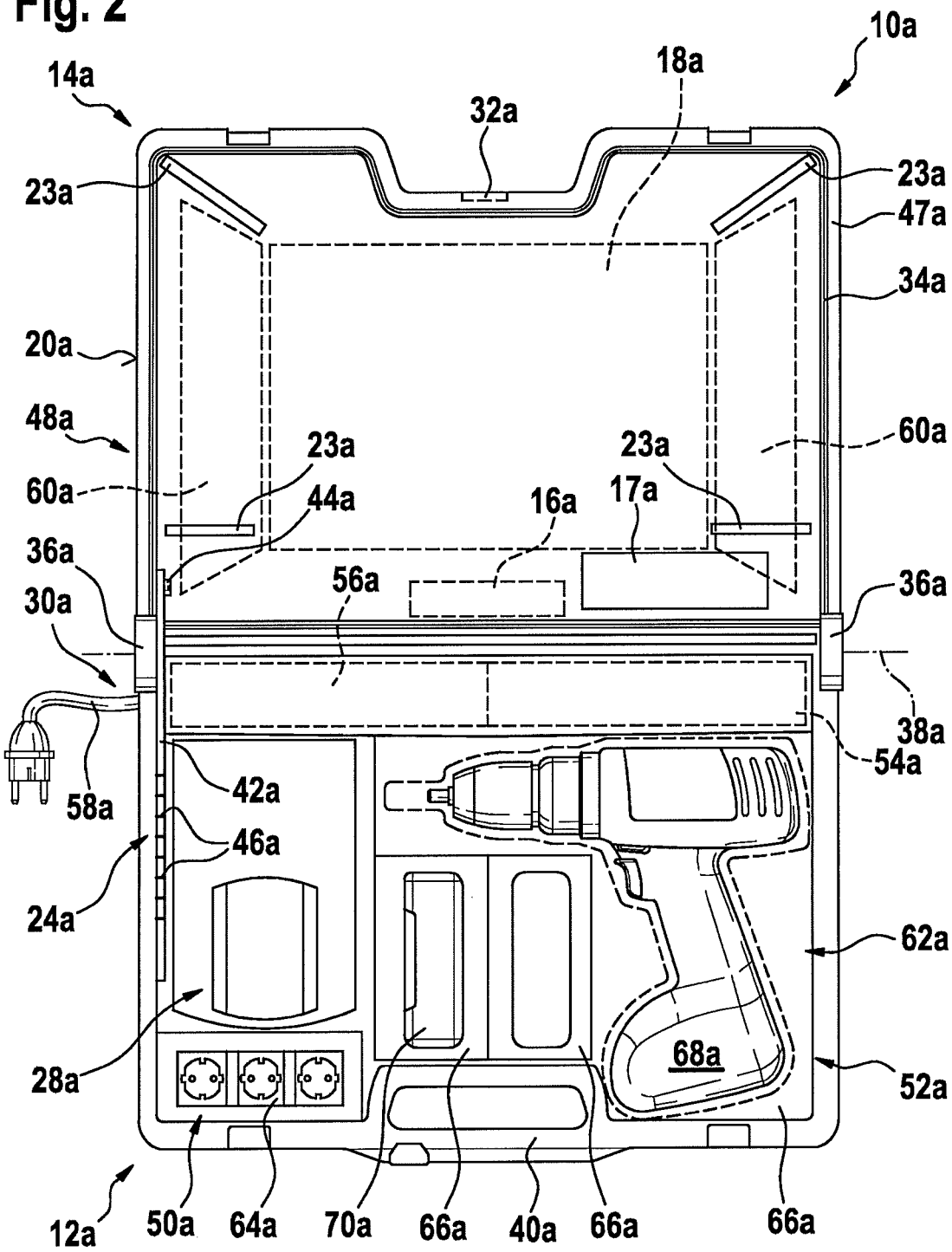
FIG. 2 shows an inner side of the handheld tool carrying case from FIG. 1 in a partly schematic representation.

FIG. 1 and FIG. 2 show an open handheld tool carrying case 10*a* having a carrying case base 12*a*, a carrying case cover 14*a* and two connecting devices 36*a*. Connecting devices 36*a* connect carrying case base 12*a* and carrying case cover 14*a* in such a way that an operator is able to separate them without use of a tool. In addition, connecting devices 36*a* support carrying case cover 14*a* so as to be movable about an axis of rotation 38*a* between a shown open state and a closed state. Moreover, in this exemplary embodiment, connecting devices 36*a* connect carrying case base 12*a* and carrying case cover 14*a* in a partially conductive manner for transmitting electrical energy. Carrying case base 12*a* and carrying case cover 14*a* are developed in a shell-shaped manner. Carrying case base 12*a* has a handle 40*a*.

Carrying case cover 14*a* has a lighting device 18*a*. Lighting device 18*a* comprises multiple lighting elements, light guides and advantageously diffusers (not shown). The lighting elements are developed as LEDs. The light guides transmit a light flux emitted by the LEDs to the diffusers. The diffusers emit the light flux through a light emission surface 22*a* of lighting device 18*a*. Light emission surface 22*a* forms a part of an outer side 20*a* of carrying case cover 14*a*. A seal (not shown) is disposed between a component having the light emission surface 22*a* and a component surrounding the light emission surface 22*a*. Light emission surface 22*a* is greater than 200 $cm^2$. Lighting device 18*a* emits a light flux that is greater than 100 lumens.

Carrying case cover 14*a* has an add-on module fastener 27, which in an operating state fastens a functional add-on module, in this case lighting device 18*a*. For this purpose, add-on module fastener 27*a* has latch elements and electrically conductive contacts (not shown).

Handheld tool carrying case 10*a* has an orientation device 24*a*. Orientation device 24*a* fixates carrying case cover 14*a* relative to a resting plane 26*a* of carrying case base 12*a* pivotably in various orientations. For this purpose, orientation device 24*a* has a connector 42*a*, a fastening element 44*a* and a latch 46*a*. Fastening element 44*a* fixates connector 42*a* pivotably on carrying case cover 14*a*. Latch 46*a* fixates connector 42*a* in different possible orientations with respect to carrying case base 12*a*. When carrying case cover 14*a* is open, connector 42*a* effects a fastening force between carrying case base 12*a* and carrying case cover 14*a*, which prevents an automatic closure of carrying case cover 14*a*. Other orientation devices are also possible.

Carrying case cover 14*a* has stacking arrangement 23*a*. Stacking arrangement 23*a* is developed as reinforcements of carrying case cover 14*a*. When multiple handheld tool carrying cases are stacked or when another force acts on carrying case cover 14*a*, stacking arrangement 23*a* transmits a force from a center of carrying case cover 14*a* to a side wall 47*a* of carrying case cover 14*a*. Side wall 47*a* of carrying case cover 14*a* transmits the force further in the direction of carrying case base 12*a*. Furthermore, handheld tool carrying case 10*a* has an electronic system 16*a*, battery interfaces 17*a*, 28*a*, a power input 30*a*, an electrical operating element 32*a*, a sealing arrangement 34*a*, a media playback unit 48*a*, a power distributor 50*a* and a device and accessory module 52*a*.

Electronic system 16*a* has a constant voltage source. Electronic system 16*a* supplies lighting device 18*a* with a power which is transmitted by a voltage that is constant in operation. Alternatively, electronic system 16*a* could have a constant current source. Electronic system 16*a* furthermore has a power switch which in an operating state interrupts a current supply of media playback unit 48*a*. For this purpose, electronic system 16*a* is connected in an electrically effective manner to operating element 32*a*.

Operating element 32*a* comprises two switches. It is disposed on outer side 20*a* of carrying case cover 14*a*. One switch switches lighting device 18*a* on and off. The other switch switches media playback unit 48*a* on and off. Operating element 32*a* furthermore comprises a magnetically operable switch (not shown) and a magnet. The magnetically operable switch is disposed on carrying case cover 14*a*. The magnet is disposed on carrying case base 12*a*. The magnetically operable switch of handheld tool carrying case 10*a* is actuated by a magnet of another handheld tool carrying case when multiple handheld tool carrying cases are stacked. In the process, electronic system 16*a* switches lighting device 18*a* and media playback unit 48*a* so as to be voltage-free.

Battery interfaces 17*a*, 28*a* fasten and contact a battery (not shown) when charging and discharging. The battery is developed as an handheld tool battery. First battery interface 17*a* is fixedly connected to carrying case cover 14*a*. Second battery interface 28*a* is fixedly connected to carrying case base 12*a*. In battery operation, battery interfaces 17*a*, 28*a* supply electronic system 16*a* with electrical power that is taken from the battery when discharging. Functional units supplied by electronic system 16*a*, in this case lighting device 18*a* and media playback unit 48*a*, may thus be utilized independently of a power network. In addition, battery interfaces 17*a*, 28*a* have a electronic charging circuitry (not shown) for charging the battery.

In network operation, power input 30*a* takes up energy from a power network. For this purpose, power input 30*a* has a power supply unit 54*a* and a cable extension 56*a*. Power supply unit 54*a* converts various network voltages into a direct voltage, which in network operation transmits electrical power to electronic system 16*a* and to battery interfaces 17*a*, 28*a*. Cable extension 56*a* has a power cable 58*a*, which in network operation is connected directly to a power network. An automatic system of cable extension 56*a* automatically retracts power cable 58*a* into carrying case base 12*a* when triggered to do so by an operator.

Sealing arrangement 34*a* is developed as a labyrinth seal. It is situated on an end face of carrying case cover 14*a* toward carrying case base 12*a*. When carrying case cover 14*a* is closed, sealing arrangement 34*a* effects a sealing action in accordance with protective class IP 52 between carrying case base 12*a* and carrying case cover 14*a*. This prevents to the greatest possible extent an intrusion of dirt and moisture into an accommodating region 62*a* of carrying case base 12*a*.

Media playback unit 48*a* comprises two loudspeakers 60*a* and an operating unit (not shown). Media playback unit 48*a* may output various sound media such as radio transmissions and/or digital audio formats.

Power distributor 50*a* has a multi-outlet strip 64*a*. Multi-outlet strip 64*a* connected directly to power input 30*a*. Power distributor 50*a* additionally has protective electronic circuitry (not shown).

Device and accessory module 52*a* comprises three fasteners 66*a*. Fasteners 66*a* are developed in a shell-shaped manner. One of fasteners 66*a* is provided for fastening a cordless drill 68*a*. Two of fasteners 66*a* are provided for fastening batteries 70*a*.

Figure 3:
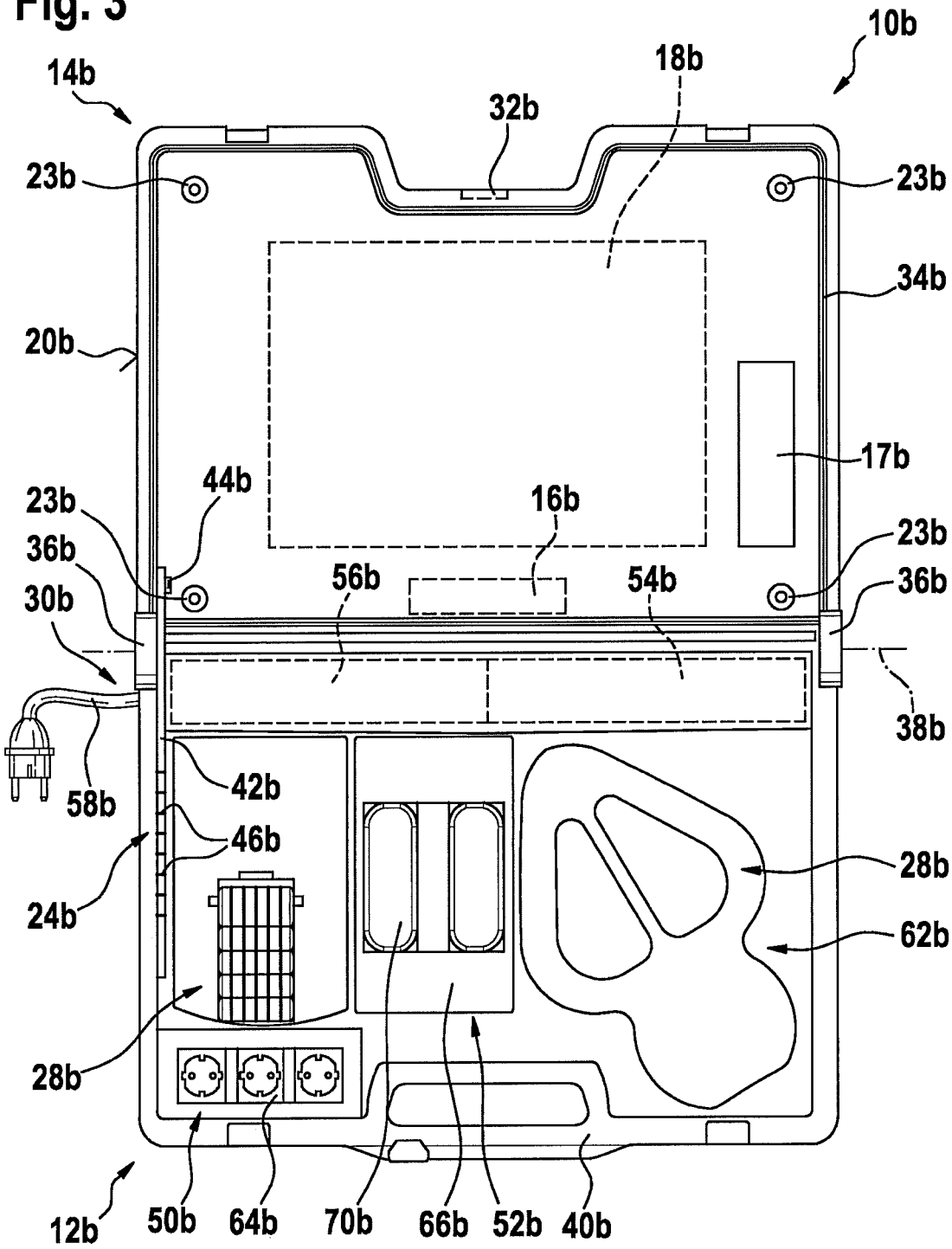
FIG. 3 shows an inner side of a second exemplary embodiment of the handheld tool carrying case from FIG. 1 in a partly schematic representation.
Figure 4:
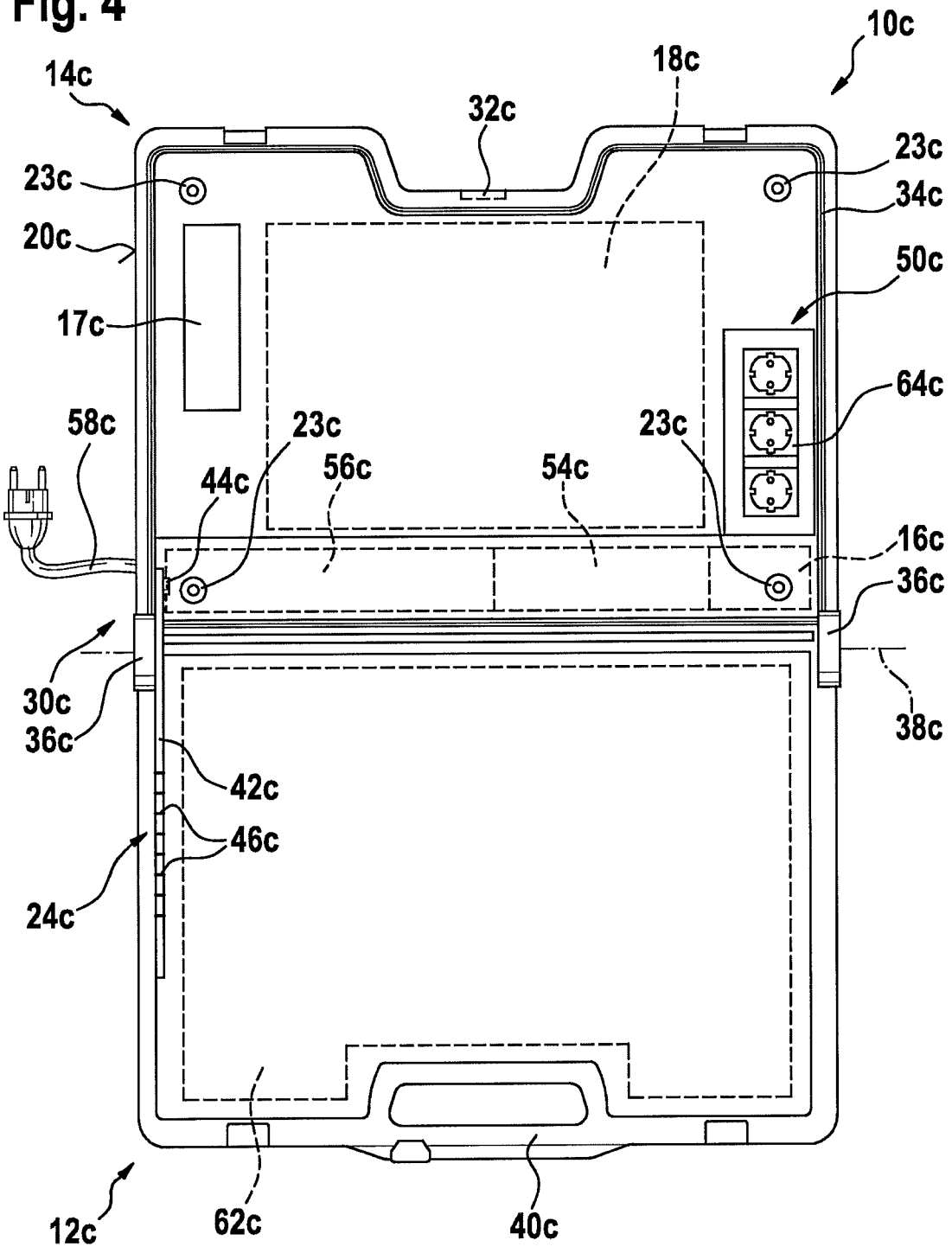
FIG. 4 shows an inner side of a third exemplary embodiment of the handheld tool carrying case from FIG. 1 in a partly schematic representation.

FIGS. 3 and 4 show two additional exemplary embodiments of the present invention. The descriptions below and the figures are limited generally to the differences between the exemplary embodiments. Regarding components that are designated in the same way, particularly regarding components having identical reference numerals, it is fundamentally possible to refer also to the figures and/or the description of the other exemplary embodiments, especially of FIGS. 1 and 2. In order to differentiate the exemplary embodiments, the letter a is added after the reference numerals of the exemplary embodiment in FIGS. 1 and 2. In the exemplary embodiments of FIGS. 3 and 4, the letter a is replaced by the letter b or by the letter c, respectively.

FIG. 3 shows a handheld tool carrying case 10*b* according to the present invention having a carrying case base 12*b* and a carrying case cover 14*b*. Carrying case cover 14*b* has an electronic system 16*b*. Carrying case base 12*b* is detachably connected to carrying case cover 14*b*. Carrying case cover 14*b* additionally has a lighting device 18*b*. Lighting device 18*b* forms a part of an outer side 20*b* of carrying case cover 14*b*. Electronic system 16*b* supplies lighting device 18*b* with electrical energy.

Carrying case base 12*b* has a power input 30*b*. In addition, carrying case base 12*b* has a power distributor 50*b* and an accessory module 52*b* for storing and fastening a battery. Carrying case base 12*b* fastens the modules in a mechanically and electrically separable fashion, the modules being electrically connected to power input 30*b* via their power plugs (not shown). Thus, it is possible to charge batteries while carrying case cover 14*b* is closed. The modules may be substituted with other modules. Power input 30*b* has a power supply unit 54*b*, a cable extension 56*b* and a power cable 58*b*.

Handheld tool carrying case 10*b* has stacking arrangement 23*b*. Stacking arrangement 23*b* is partly molded onto carrying case base 12*b* and partly onto carrying case cover 14*b*. Stacking arrangement 23*b* is developed as stacking domes. Stacking arrangement 23*b* transmits a force applied on a stacking surface directly onto carrying case base 12*b*.

FIG. 4 shows a handheld tool carrying case 10*c* according to the present invention having a carrying case base 12*c* and a carrying case cover 14*c*. Carrying case base 12*c* has an accommodating region 62*c* for handheld tools, handheld machine tools and/or accessories. Carrying case cover 14*c* has an electronic system 16*c*, a power input 30*c* and a power distributor 50*c*. Carrying case base 12*c* is connected to carrying case cover 14*c* in a separable and electrically effectively insulated fashion. Carrying case cover 14*c* additionally has a lighting device 18*c*. Lighting device 18*c* forms a part of an outer side 20*c* of carrying case cover 14*c*. Electronic system 16*c* supplies lighting device 18*c* with electrical energy. Power input 30*c* has a power supply unit 54*c*, a cable extension 56*c* and a power cable 58*c*. As an alternative to power input 30*c*, handheld tool carrying case 10*c* could also have a battery interface, which is only provided to discharge a rechargeable battery and/or a battery and to supply electronic system 16*c*.

What is claimed is:

1. A handheld tool carrying case, comprising:

a carrying case base;

a carrying case cover; and at least one electronic system;

wherein the carrying case base is connected to the carrying case cover in a detachable fashion such that the carrying case base and the carrying case cover are configured to be completely separated from each other without the use of a tool, wherein the carrying case cover has at least one battery interface which is at least partly fixedly connected to the carrying case cover, wherein the at least one battery interface is disposed on an inner surface of the carrying case cover such that an at least one battery is insertable only when the carrying case is at least in a partially open state with respect to the carrying case body, wherein at least one of the carrying case base and the carrying case cover has at least one lighting device which is at least partly fixedly connected to the at least one of the carrying case base and the carrying case cover, wherein the lighting device includes a plurality of light emitting elements embodied as LEDs and a plurality of diffusers which emit a light flux emitted by the light emitting elements through a light emission surface of the lighting device, wherein the lighting device emits a light flux that is greater than 100 lumens.

2. The handheld tool carrying case as recited in claim 1, further comprising:

a lighting device; and an orientation device to fixate at least one part of one of the carrying case base or of the carrying case cover pivotably in various orientations relative to a resting plane of the one of the carrying case base or of the carrying case cover.

3. The handheld tool carrying case as recited in claim 1, wherein the lighting device forms at least part of an outer side of the carrying case.

4. The handheld tool carrying case as recited in claim 1, wherein the lighting device has a light emission surface which is greater than 50 $cm^2$.

5. The handheld tool carrying case as recited in claim 1, further comprising:

a stacking arrangement configured to transmit a force in a direction of at least one of the carrying case base and the carrying case cover.

6. The handheld tool carrying case as recited in claim 1, wherein at least one of the carrying case base and the carrying case cover has at least one add-on module fastener to fasten a functional add-on module.

7. The handheld tool carrying case as recited in claim 1, wherein the at least one battery interface is configured to supply the electronic system with electrical power.

8. The handheld tool carrying case as recited in claim 1, further comprising:

a power input configured to take up energy from a power network.

9. The handheld tool carrying case as recited in claim 1, further comprising:

an electrical operating element situated so as to be operable when the carrying case cover is closed.

10. The handheld tool carrying case as recited in claim 9, wherein the operating element is situated to be actuated by stacking multiple handheld tool carrying cases.

11. The handheld tool carrying case as recited in claim 1, wherein the carrying case base is detachably connected to the carrying case such that it may be detached in a non-destructive manner.

12. The handheld tool carrying case as recited in claim 7, wherein the battery interface is fixedly connected to the carrying case cover.

13. The handheld tool carrying case as recited in claim 2, wherein the resting plane faces away from the light emission surface in at least one operating state by more than 150 degrees.

14. The handheld tool carrying case as recited in claim 1, further comprising:

an electrical operating element embodied as a switch, wherein the electrical element is configured to switch on and switch off the light device.

15. The handheld tool carrying case as recited in claim 6, wherein the add-on module fastener has latch elements and electrically conductive contact elements.

16. The handheld tool carrying case as recited in claim 2, wherein the orientation device comprises:

a connecting element;

a fastening element; and a latching element, wherein the fastening element is configured to fix the connecting element relative to the carrying base or the carrying case cover, and the latch element is configured to fixate the connecting element to the carrying case base or the carrying case cover.

17. The handheld tool carrying case as recited in claim 1, wherein the handheld tool carrying case has a media playback unit.

18. The handheld tool carrying case as recited in claim 1, wherein the carrying case base has at least one fastener for a handheld tool.

19. The handheld tool carrying case as recited in claim 17, further comprising:

an electrical operating element embodied as a switch, wherein the electrical element is configured to switch on and switch off the media playback unit.

20. A handheld tool carrying case, comprising:

a carrying case base;

a carrying case cover;

a lighting device which forms at least a part of an outer side of the carrying case cover;

at least one electronic system configured to supply power to the lighting device; and at least one battery interface configured to supply power to the electronic system, the at least one battery interface disposed on an inner surface of the carrying case cover such that an at least one battery is insertable only when the carrying case is at least in a partially open state with respect to the carrying case body;

wherein the carrying case base is connected to the carrying case cover in a detachable fashion such that the carrying case base and the carrying case cover are configured to be completely separated from each other without the use of a tool, wherein the lighting device includes a plurality of light emitting elements embodied as LEDs and a plurality of diffusers which emit a light flux emitted by the light emitting elements through a light emission surface of the lighting device, wherein the lighting device emits a light flux that is greater than 100 lumens.

21. The handheld tool carrying case as recited in claim 20, wherein the light emission surface of the lighting device is greater than 200 $cm^3$.

* * * * *